US011189968B2

(12) United States Patent
Ross et al.

(10) Patent No.: US 11,189,968 B2
(45) Date of Patent: Nov. 30, 2021

(54) DEVICE AND METHOD FOR LOCKING MULTIPLE ANGULAR CONNECTORS

(71) Applicant: THE BOEING COMPANY, Chicago, IL (US)

(72) Inventors: Don W. Ross, Summerville, SC (US); Rajiv D. Patel, Mount Pleasant, SC (US); Stephen K. Long, Ladson, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/738,164

(22) Filed: Jan. 9, 2020

(65) Prior Publication Data

US 2021/0218186 A1 Jul. 15, 2021

(51) Int. Cl.
*H01R 13/639* (2006.01)
*H01Q 1/28* (2006.01)

(52) U.S. Cl.
CPC ..... *H01R 13/639* (2013.01); *H01Q 1/28* (2013.01); *H01R 2201/26* (2013.01)

(58) Field of Classification Search
CPC ..... H01R 13/639; H01R 13/4361
USPC ..... 439/694, 689, 690, 685
See application file for complete search history.

(56) References Cited

U.S. PATENT DOCUMENTS 3,016,512 A * 1/1962 Borchard ..... H01R 25/00 439/225
3,514,745 A * 5/1970 De Lyon ..... H01R 13/56 439/683
3,519,978 A * 7/1970 Taormina ..... H01R 13/46 439/596
3,551,877 A * 12/1970 Sterling ..... H01R 13/41 439/597
3,777,301 A * 12/1973 Michaels ..... H01R 25/00 439/749
3,865,452 A * 2/1975 Pittman ..... H01T 4/08 439/182
4,056,299 A * 11/1977 Paige ..... H01R 4/4818 439/439
4,109,992 A * 8/1978 Hughes ..... H01R 13/567 439/620.21
4,534,609 A * 8/1985 White ..... H01R 24/76 439/190
5,173,060 A * 12/1992 Shimirak ..... H01R 4/2408 439/416

(Continued)

*Primary Examiner* — Neil Abrams
(74) *Attorney, Agent, or Firm* — Marshall, Gerstein & Borun LLP

(57) ABSTRACT

A device for securing at least two angular connectors includes a first component, which includes at least two first openings; at least two second openings defined through a perimeter wall structure, which extends about the first wall structure; and at least two wall members including at least two first channels. Each of the at least two wall members extend between one of the at least two second openings and one of the at least two first openings. A second component positioned below the first component includes a second wall structure defining at least two third openings, at least two second channels extending between one of the at least two third openings and one of the at least a two fourth openings of second perimeter wall. Each of the at least second channels slope extending downwardly toward the second perimeter wall facilitating drainage of moisture.

20 Claims, 8 Drawing Sheets

(56) References Cited

U.S. PATENT DOCUMENTS

| | | | | | |
|---|---|---|---|---|---|
| 5,516,301 | A * | 5/1996 | Kawakita | H01R 13/5227 | 439/206 |
| 6,086,413 | A * | 7/2000 | Karasik | H01R 13/405 | 439/516 |
| 6,109,952 | A * | 8/2000 | Jaag | H01R 4/4827 | 439/224 |
| 6,119,668 | A * | 9/2000 | Richards | F02P 11/00 | 123/143 C |
| 6,165,009 | A * | 12/2000 | Anbo | H01R 12/81 | 439/498 |
| 6,254,436 | B1 * | 7/2001 | Nitta | B60Q 1/0088 | 439/689 |
| 6,345,990 | B1 * | 2/2002 | Hyzin | H01R 12/7082 | 439/74 |
| 6,666,708 | B2 * | 12/2003 | Saito | H01R 12/727 | 439/372 |
| 7,147,503 | B2 * | 12/2006 | Shindo | H01R 13/6277 | 439/354 |
| 7,637,785 | B2 * | 12/2009 | Irish | H01R 13/6315 | 439/658 |
| 7,766,696 | B2 * | 8/2010 | Conner | H01R 13/518 | 439/581 |
| 7,950,968 | B2 * | 5/2011 | Qian | H01R 13/506 | 439/689 |
| 8,192,229 | B2 * | 6/2012 | Endo | H01R 13/501 | 439/596 |
| 10,148,049 | B2 * | 12/2018 | Yi | H01R 13/518 | |
| 2021/0218186 | A1 * | 7/2021 | Ross | H01R 13/639 | |

* cited by examiner

DEVICE AND METHOD FOR LOCKING MULTIPLE ANGULAR CONNECTORS

FIELD

The apparatus of this disclosure relates to a device and a method to secure connectors and more particularly to secure angled connectors from being loosened or overtightened.

BACKGROUND

In the fabrication of an aircraft angular connectors are installed and are used in the operation of the aircraft. Angular connectors facilitate completing electrical connections which permit transmission of operational signal data or power within the aircraft. An example of an angled connector in use includes for example connecting an antenna connector positioned within the aircraft to a cable with the angular connector. The angular connector has a first portion, which connects to the antenna connector and has a second portion, which angularly extends away from the first portion and connects to a cable. The cable in turn transmits data signals received from the antenna to desired parts of the aircraft or if the angular connector is connected to an electrical power supply, the cable to which the angular connector is in turn connected transmits the power received by the power supply. In other applications of use of an angular connector, which can be employed associated aircraft or with other structures similarly include having a first portion, which connects to a fluid connector or to a gas connector and has a second portion which angularly extends away from the first portion and connects to a conduit to appropriately carry the gas or fluid to other locations.

The second portion of the angular connector, along with the cable or conduit to which the second portion is connected, angularly extends away from the first portion of the angular connector. The second portion and the cable or conduit establish a moment arm with respect to the first portion of the angular connector. A force applied to either the second portion of the connector and/or to the cable or conduit connected to the second portion, the second portion and transmits a torque to the first portion of the connector. The resulting torque applied to the first portion can result in the first portion experiencing overtightening or loosening of the electrical, fluid or gas connection the first portion has with a connector for carrying, for example, an antenna signal, electrical power, fluid or gas.

Angular connectors can include one of a wide variety of angular relationships between the first and second portions. Ninety degree angular connectors are employed, for example, in an aircraft with respect to making an electrical signal connection with antenna connectors positioned inside of the aircraft. The ninety degree angular electrical connectors are often positioned in a group of two or more angular connectors in close proximity to one another.

The cable and/or the second portion of the ninety degree connector connected to the cable can experience an accidental impact force during fabrication of the aircraft and can receive vibrational forces during operation of the aircraft. Similarly, with respect to forces applied in other structural environments involving connections including signals, power, fluid or gas these forces can generate a torque transmitted to the first portion of the connector. The torque imparted to the first portion of the angular connector can promote, as mentioned earlier, loosening or overtightening of the first portion of the angular connector with respect to the particular connector to which the angular connector is connected, which can involve power, signal, fluid or gas transmissions.

In an example of a loosening or overtightening of the first portion of the angular connector connected to an antenna connector in an aircraft can result in numerous aircraft maintenance disruptions and costly delays. Existing solutions are to use stand-offs and posts to secure the cable to the structure of the aircraft. However, these methods require minimum distance from the connector which creates a moment arm.

As a result, there is a need to provide a way to secure angular connectors, which are positioned in a group of two or more angular connectors positioned in close proximity to one another, so as not to transmit a torque to the first portions of the two or more angular connectors. There is also a need to protect angular connectors from moisture and/or condensation which can be created from operational cycles for example of an aircraft attaining altitude and landing. Such moisture or condensation can promote unwanted corrosion of the angular connectors.

SUMMARY

An example includes a device for securing at least two angular connectors, which includes a first component which includes: at least two first openings defined through a first wall structure; at least two second openings defined through a perimeter wall structure, which extends about the first wall structure; and at least two wall members, wherein each of the at least two wall members extend away from one of the at least two second openings and toward one of the at least two first openings.

An example includes a method for securing at least two angular connectors, which includes placing each of at least two first portions of at least two angular connectors to align with one of at least two first openings defined through a first wall structure of a first component.

The features, functions, and advantages that have been discussed can be achieved independently in various embodiments or may be combined in yet other embodiments further details of which can be seen with reference to the following description and drawings.

DESCRIPTION

Figure 1:
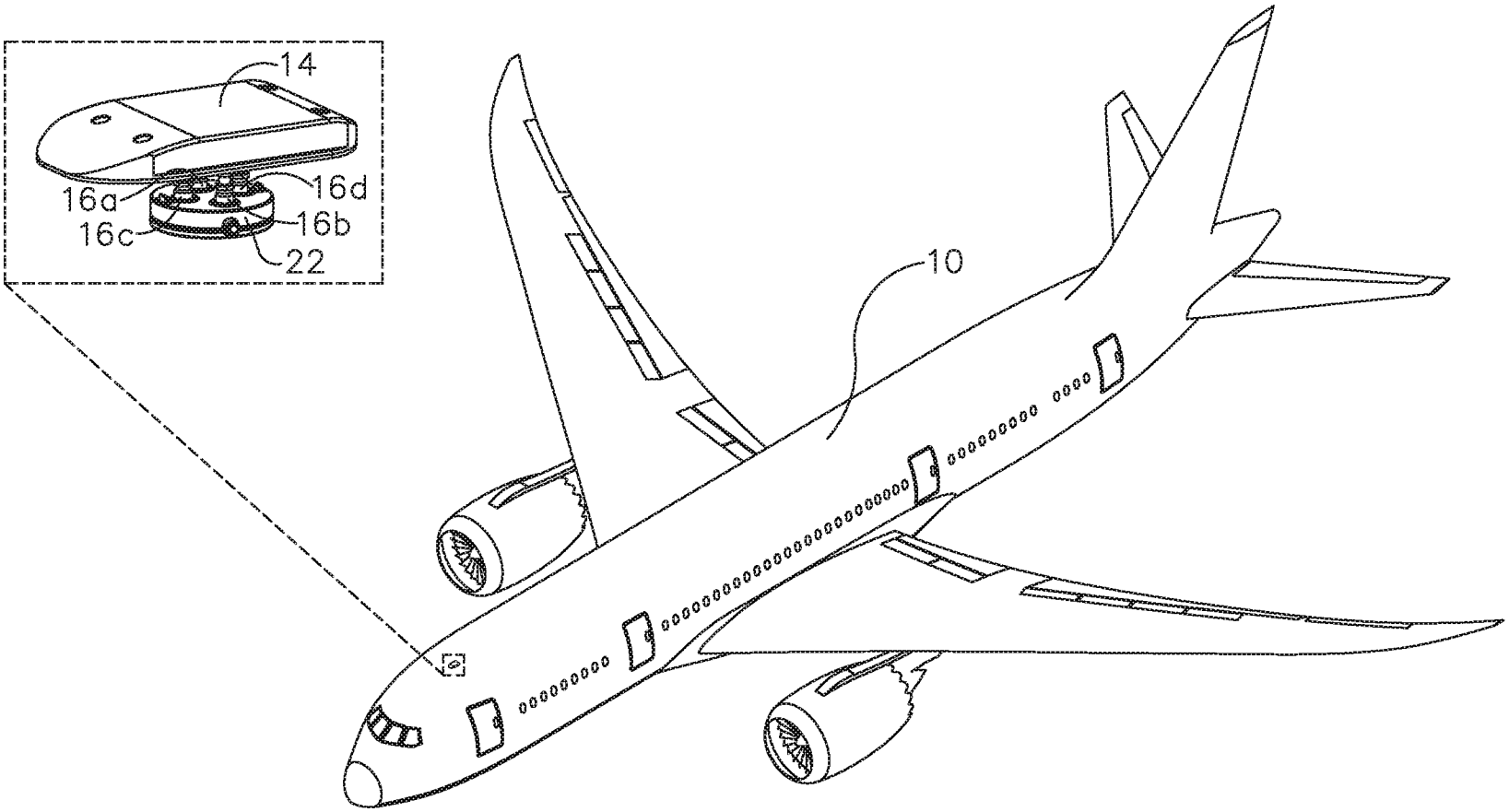
FIG. 1 is a top perspective view of an aircraft with an enlarged view of angular connectors connected to an antenna module positioned on the inside of the fuselage and positioned within a device for locking multiple angular connectors.

Angular connectors have a portion which extends angularly away from another portion, such that each portion can create a moment arm relative to the each other. This is also the case when a cable or conduit, for example, is connected to one of the portions of the angular connector such that the cable or conduit extends the moment arm of the particular portion to which the cable or conduit is connected. As mentioned earlier, angular connectors can be employed in a variety of uses such as connected, in the example to be described herein, to an antenna connector and in turn to a cable to distribute the antenna signals received from the antenna connector. Other examples, include the angular connector is connected to an electrical power connector and in turn to an electrical power cable which distributes electrical power. Additional applications of use of angular connectors include angular connectors secured to a gas of a fluid connector and in turn the angular connector transmits the gas or fluid to a conduit to which the angular connector is secured and the conduit distributes the gas or fluid.

Thus, with a force imparted on a portion of the angular connector and/or onto the cable or conduit connected to that portion, a torque is applied to the other portion of the angular connector. The torque applied to the other portion of the angular connector, depending on the direction of the torque, can either overtighten or loosen the other portion's connection to another connector. This is particularly the case when the other portion's connection to another connector is a threaded connection. The overtightening or loosening of the other portion's connection with another connector results in costly maintenance.

In the use of angular connectors, there is a need to prevent overtightening and or loosening of the angular connectors. This is the case, for example, in the fabrication of and in the operation of an aircraft, as mentioned earlier, in which two or more angular connectors are positioned in proximity to one another which facilitate transmission of electrical signals within an aircraft. As will be appreciated, as described herein, the solution to preventing unwanted torque being applied to a first portion of an angular connector has at least two angular connectors being positioned in proximity to one another.

In the example of this disclosure shown in FIGS. 1-8, at least two angular connectors are positioned in proximity to one another, which includes four angular connectors which facilitate transmission of signals received from an antenna connector. It should be understood this disclosure will optimally operate with two angular electrical connectors being present or more regardless of what is being transmitted, signals, power, gas or fluid.

In an example of use of angular connectors described herein, the angular connectors in this example carry electrical signals received from antenna connectors to cables attached to the angular connectors. As seen in FIGS. 1-4, aircraft 10 has antennas (not shown) which have antenna connectors 12*a*-12*d* extending from an antenna module 14 in proximity to one another. At least two angular connectors 16*a*-16*d* are connected to antenna connectors 12*a*-12*d*, respectively and each of the at least two angular connectors 16*a*-16*d* in turn are connected to cables 18 so as to transmit data from the antennas (not shown) to desired locations within aircraft 10. The connection between antenna connectors 12*a*-12*d* and at least two angular connectors 16*a*-16*d* in this example are threaded (not shown) and secured with nut members 20*a*-20*d* of at least two angular connectors 16*a*-16*d*, respectively and the connection between cable 18 and at least two angular connectors 16*a*-16*d* include one of a variety of standard cable connections.

Figure 6:
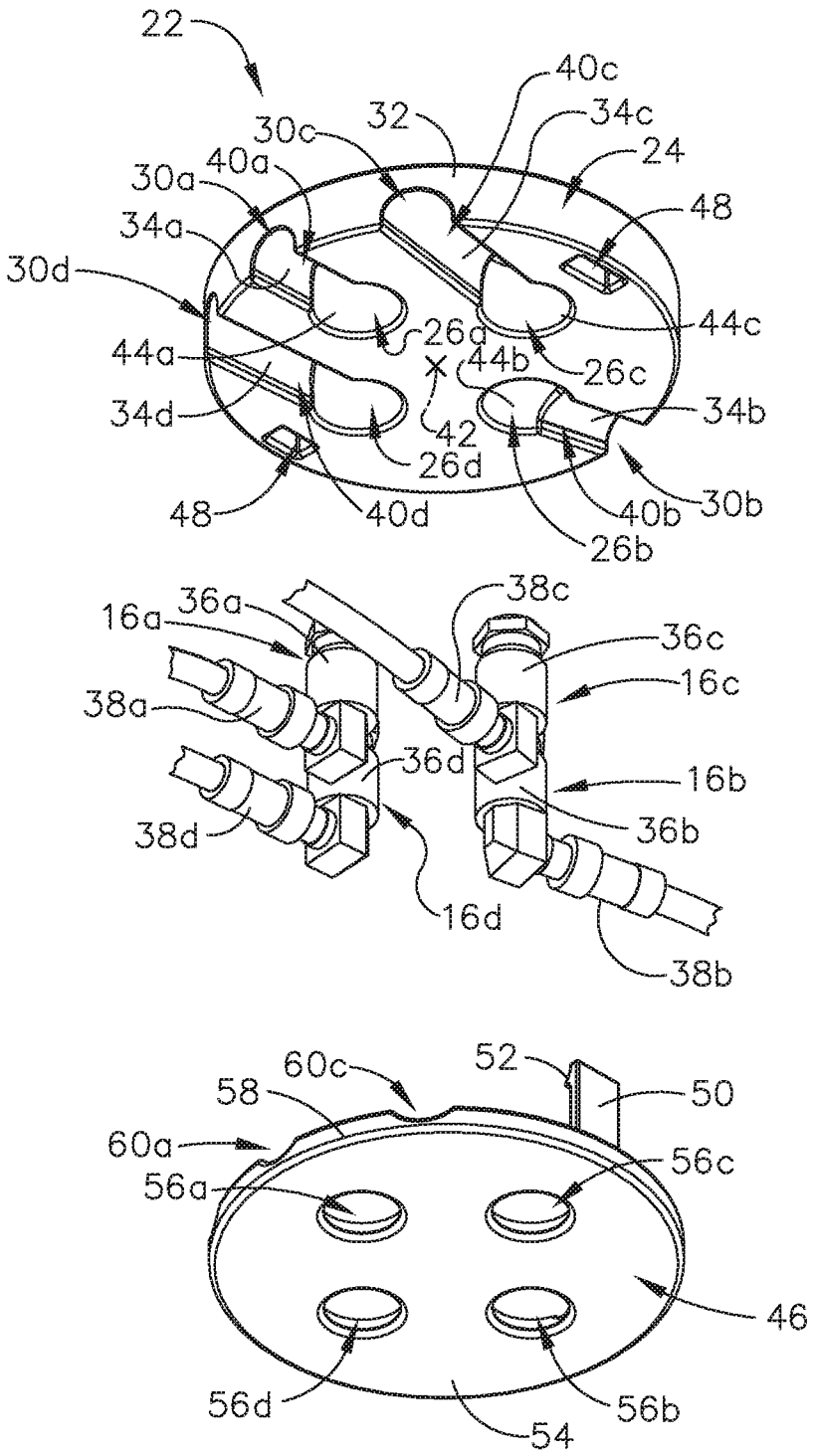
FIG. 6 is an exploded bottom perspective view of FIG. 4.

Device 22 for securing at least two angular connectors 16*a*-16*d* includes first component 24 which includes at least two first openings 26*a*-26*d* defined through first wall structure 28. First component 24 includes at least two second openings 30*a*-30*d* defined through perimeter wall structure 32, as seen in FIG. 6, which extends about first wall structure 28. In addition, first component 24 includes at least two wall members 34*a*-34*d*, as seen in FIG. 6, wherein each of the at least two wall members 34*a*-34*d* extends away from each of the at least two second openings 30*a*-30*d*, respectively, and toward one of the at least two first openings 26*a*-26*d*.

Figure 2:
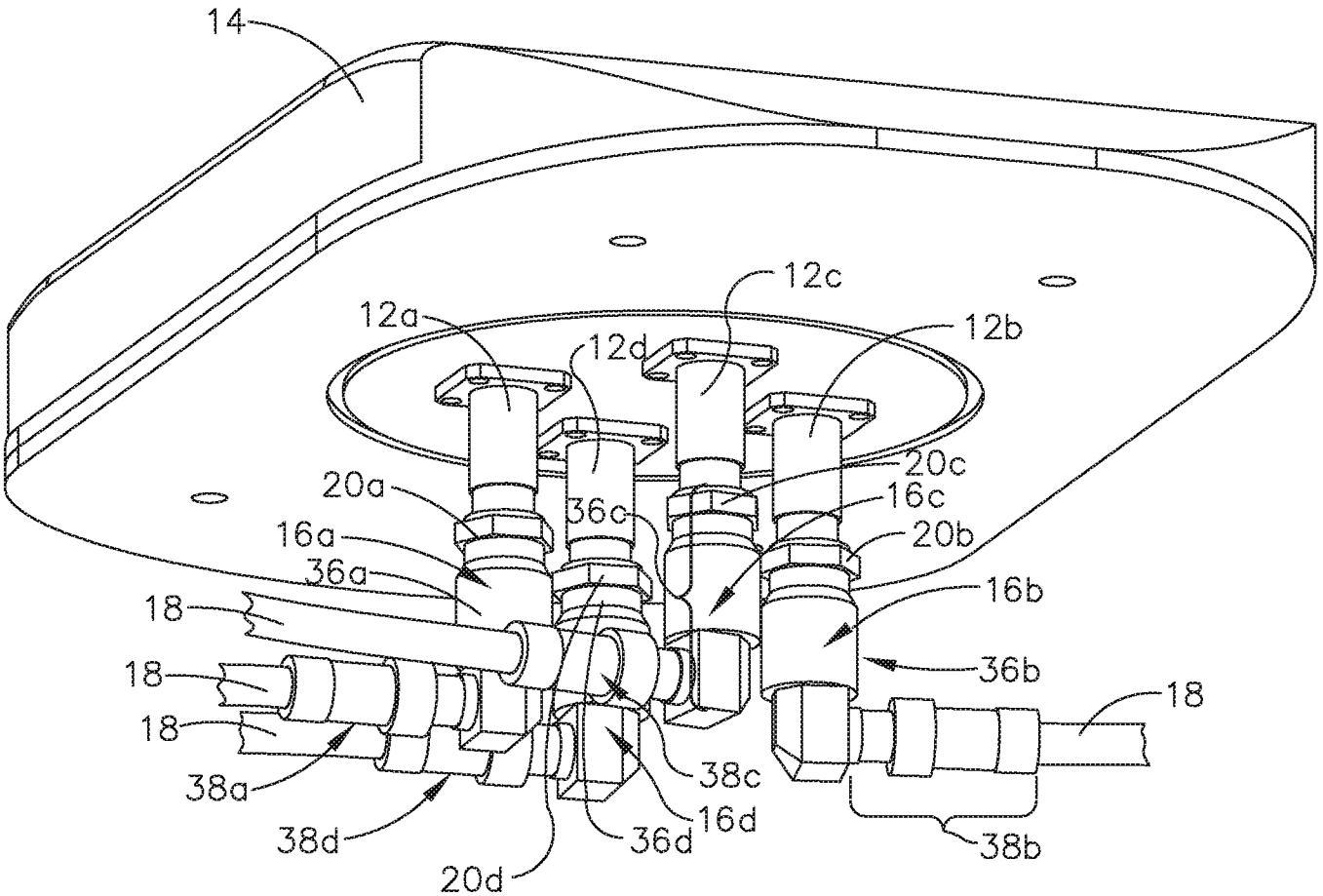
FIG. 2 is an enlarged perspective view of multiple angular electrical connectors connecting to antenna connectors extending from the antenna module without a device for locking multiple angular connectors.

With at least two angular connectors 16*a*-16*d* positioned in first component 24, at least two angular electrical connectors 16*a*-16*d* include at least two first portions 36*a*-36*d* such that one of the at least two first portions 36*a*-36*d*, as seen in FIG. 2, is associated with one of the at least two angular connectors 16*a*-16*d* and each of the at least two first portions 36*a*-36*d* aligns with one of the at least two first openings 26*a*-26*d*. At least two angular connectors 16*a*-16*d* include at least two second portions 38*a*-38*d*, as seen in FIG. 2, such that one of at least two second portions 38*a*-38*d* is associated with one of at least two angular connectors 16*a*-16*d* and each of at least two second portions 38*a*-38*d* aligns with one of at least two second openings 30*a*-30*d*, as seen in FIGS. 3-6. Each of at least two wall members 34*a*-34*d* is positioned adjacent to and extends along one of at least two second portions 38*a*-38*d* of each of the at least two angular connectors 16*a*-16*d* with the at least two angular connectors 16*a*-16*d* positioned in first component 24.

Each of the at least two wall members 34*a*-34*d* extends between one of the at least two second openings 30*a*-30*d* and one of the at least two first openings 26*a*-26*d*, as seen in FIG. 6. Each of the at least two wall members 34*a*-34*d* includes one of at least two first channels 40*a*-40*d* such that each one of the at least two first channels 40*a*-40*d* associates with one of the at least two first openings 26*a*-26*d* and one of the at least two second openings 30*a*-30*d*.

Figure 7:
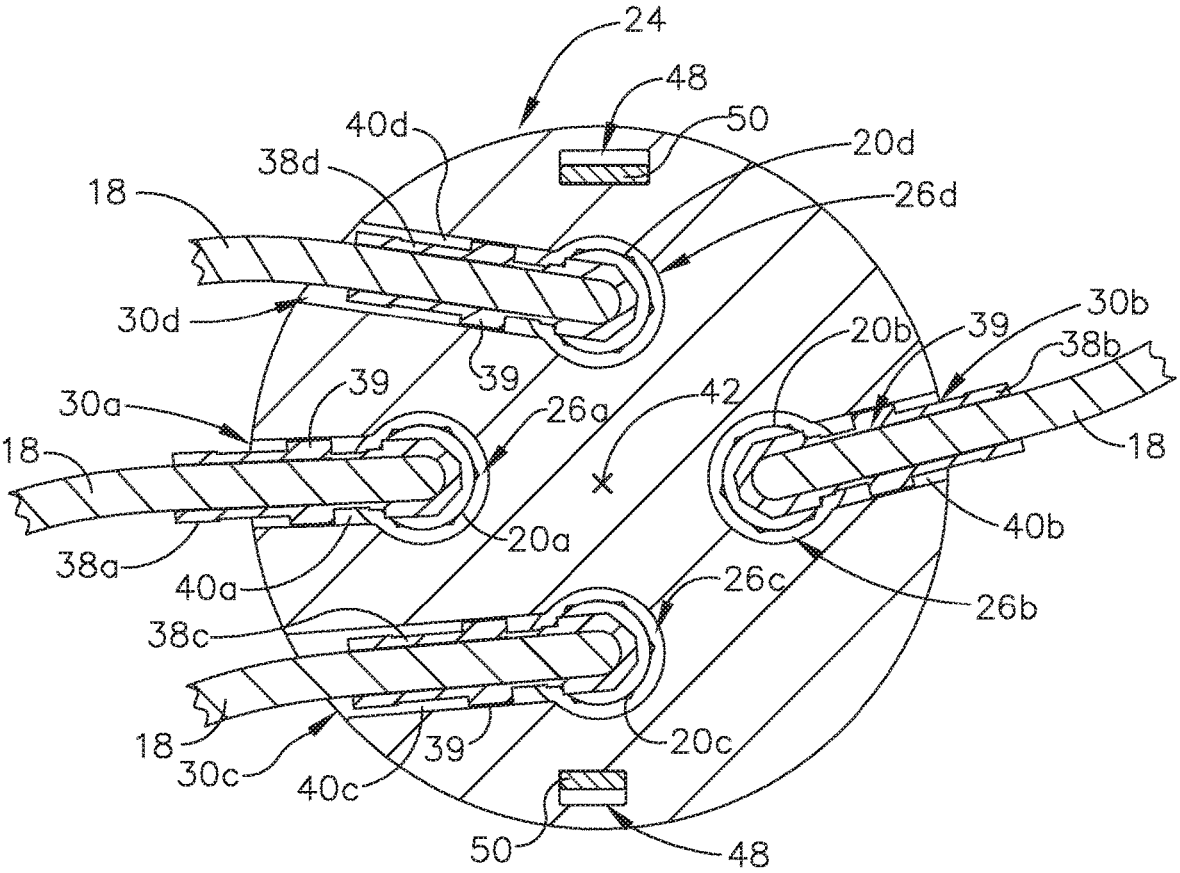
FIG. 7 is a cross section view along line 7-7 of FIG. 4.

With at least two angular connectors 16*a*-16*d* positioned in first component 24, each of the at least two first channels 40*a*-40*d* is in contact with one of the at least two second portions 38*a*-38*d*. Contact, in this example, includes collar 39 positioned about at least two second portions 38*a*-38*d*, as seen in FIG. 7 contacting the at least two first channels 40*a*-40*d*. With at least two angular connectors 16*a*-16*d* positioned in the first component 24, each of the at least two first portions 36*a*-36*d* is aligned with one of the at least two first openings 26*a*-26*d* and each of the at least two second portions 38*a*-38*d* is positioned within one of the at least two first channels 40*a*-40*d*, such that at least one of the at least two second portions 38*a*-38*d* extends through one of the at least two second openings 30*a*-30*d*, such as seen with respect to one of at least two second portions 38*a* in FIG. 7 extends through one of at least two second openings 30*a*, or cable 18 connected to one of the at least two second portions 38*a*-38*d*, such as seen with respect to cable 18 connected to one of at least two second portions 38*c* in FIG. 7, wherein cable 18 extends through one of at least two second openings 30*c*. These configurations associated with the cable 18 also apply to that of conduits (not shown), for carrying gas or fluid.

Figure 4:
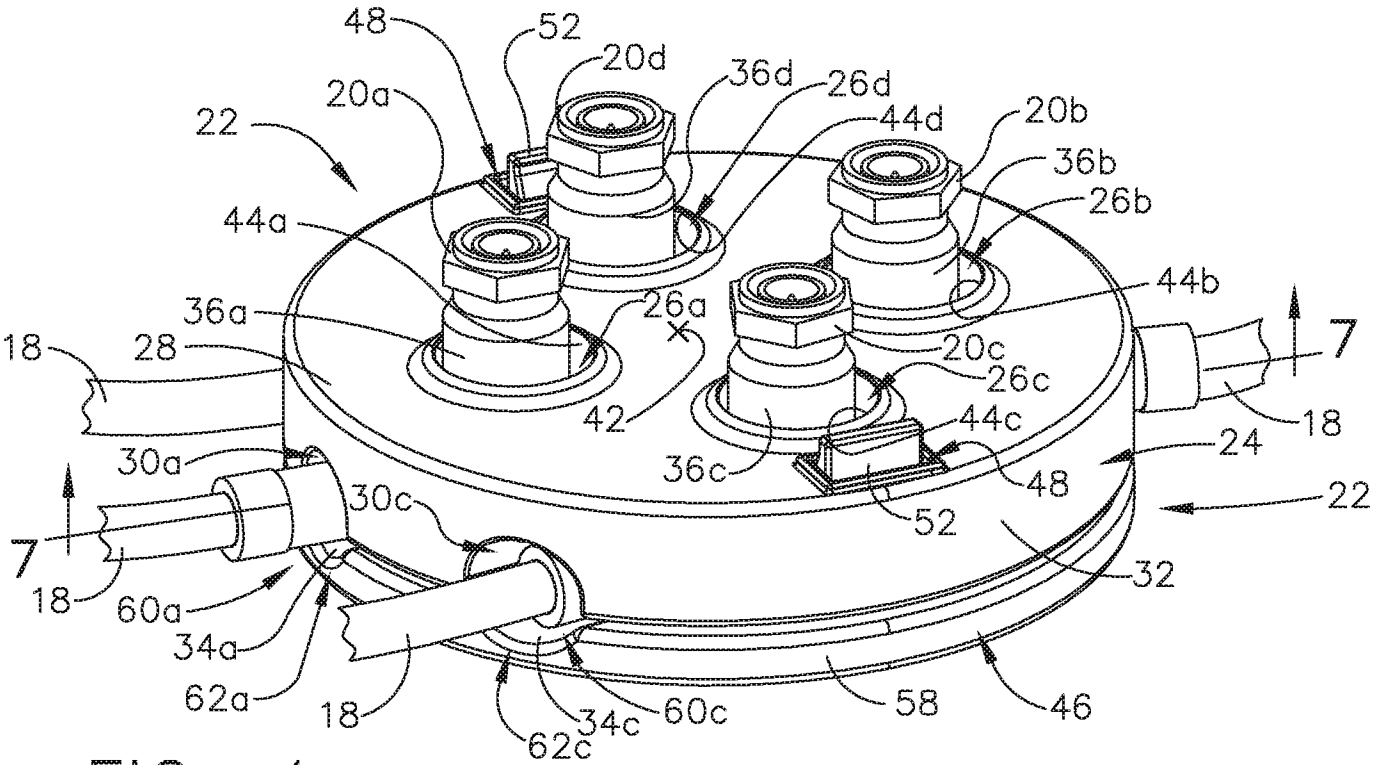
FIG. 4 is a top perspective isolated view of the multiple angular connectors positioned within the device for locking multiple angular connectors as seen in FIG. 3.

In this example, each of the at least two first openings 26*a*-26*d* are positioned spaced apart from a central axis 42 of the first component 24. In addition, in this example, each of the at least two first openings 26*a*-26*d* includes one of at least two sidewalls 44*a*-44*d* associated with each of the at least two first openings 26*a*-26*d*, as seen in FIGS. 4-6.

Device 22 includes second component 46 releasably secured to first component 24. One of the first component 24 or second component 46 define a pair of securement openings 48 which extend through one of the first component 24 or the second component 46. In this example pair of securement openings 48 are positioned through first component 24, as seen in FIGS. 4-7. Other of the first component 24 or second component 46, include a pair of tab members 50, which in this example includes second component 46 carrying pair of tab members 50. Each of the pair of tab members 50 have a head member 52 such that with the head member 52 of each of the pair of tab members 50 positioned through the pair of securement openings 48, the first component 24 is releasably secured to the second component 46. In this example, with each head member 52 passing through securement openings 48, each of the pair of tab members 50 flex away from central axis 42 and as each head member 52 clears past one of the pair of securement openings 48, the tab member 50 associated with the head member 52 which passes through one of the pair of securement openings 48 flexes back toward central axis 42 positioning the head member 52 onto first component 24 applying a compressive force between first component 24 and second component 46.

First and second components 24, 46 can be fabricated with one of a variety of processes including such processes as one of molding or three dimensional printing. The construction of the first and second components 24, 46 can include one of a variety of open and/or closed wall constructions as desired.

Figure 3:
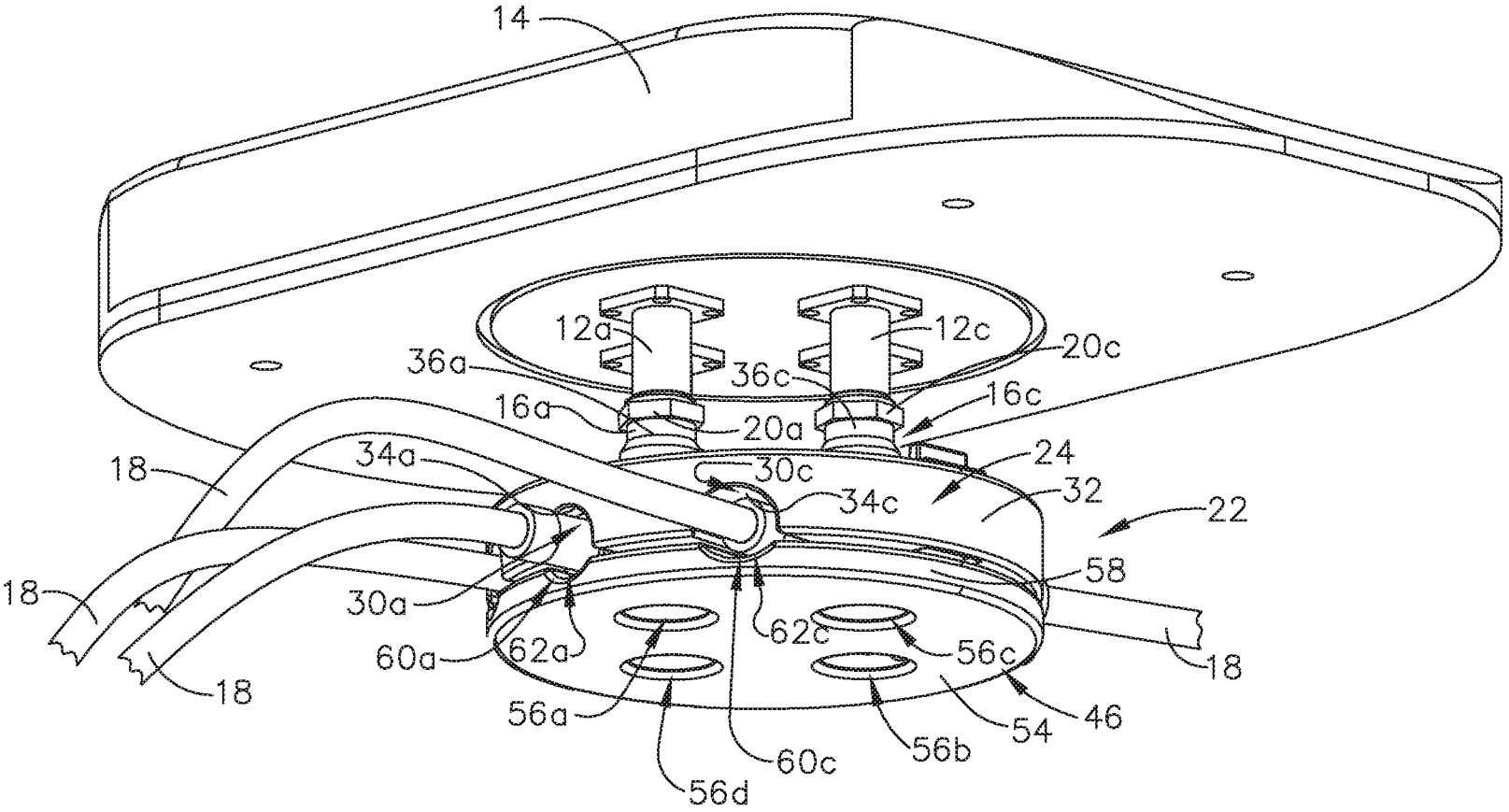
FIG. 3 is the view of FIG. 2 with the multiple angular connectors positioned within the device for locking multiple angular electrical connectors as seen in FIG. 1.
Figure 5:
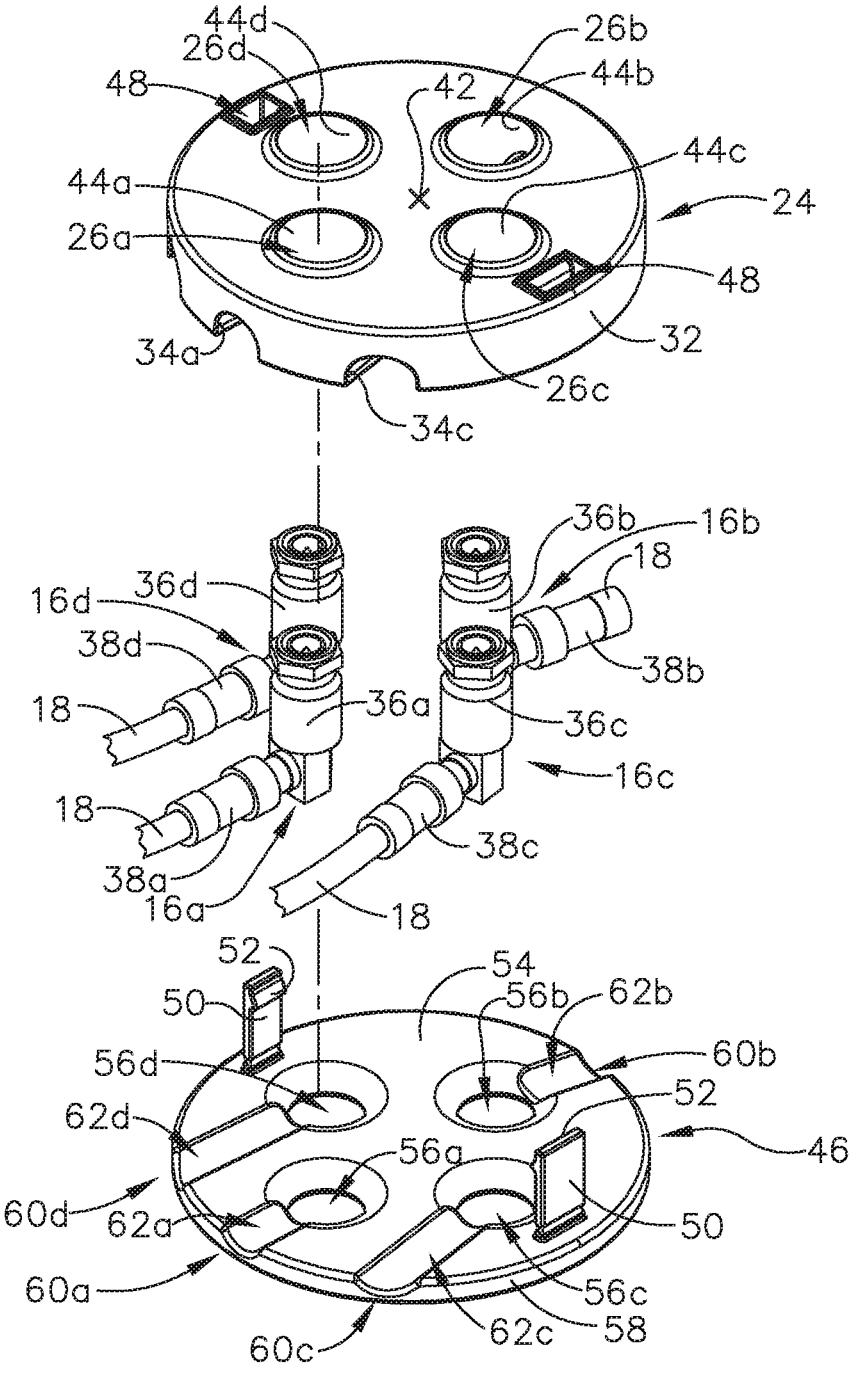
FIG. 5 is an exploded top perspective view of FIG. 4.

Second component 46 has second wall structure 54 which defines at least two third openings 56*a*-56*d* extending through second wall structure 54, as seen in FIGS. 3 and 5-6. Second component 46 has second perimeter wall structure 58 which defines at least two fourth openings 60*a*-60*d* extending through second perimeter wall structure 58 wherein second perimeter wall structure 58 extends about second wall structure 54. Second component 46 includes at least two second channels 62*a*-62*d* wherein each of the at least two second channels 62*a*-62*d* extends between one of the at least two fourth openings 60*a*-60*d* of second perimeter wall structure 58 and one of at least two third openings 56*a*-56*d*.

With first and second components 24, 46 releasably secured together each of the at least two second channels 62*a*-62*d* of the second component 46 align with one of the at least two first channels 40*a*-40*d* of the first component 24, as seen in FIGS. 5 and 6. With the at least two angular connectors 16*a*-16*d* positioned between first component 24 and second component 46, each of at least two first portions 36*a*-36*d* of the at least two angular connectors 16*a*-16*d* is aligned with one of the at least two first openings 26*a*-26*d* and each of at least two second portions 38*a*-38*d* of the at least two angular connectors 16*a*-16*d*, is aligned and within one of at least two first channels 40*a*-40*d* and aligned and within one of at least two second channels 62*a*-62*d*, as seen in FIGS. 5 and 6. In this example, each at least two second portions 38*a*-38*d* have collar 39, as earlier mentioned and seen in FIG. 7, which is positioned in contact with each of the at least two first channels 40*a*-40*d* and with each of corresponding at least two second channels 62*a*-62*d* thereby providing a snug fit with first and second components in a secured position.

Each of the at least two third openings 56*a*-56*d* of the second wall structure 54 of the second component 46 is aligned with one of the at least two first openings 26*a*-26*d* of the first component 24. Device 22, in this example, has with the alignment of at least two third openings 56*a*-56*d* with at least two first openings 26*a*-26*d*, which facilitates any moisture or condensation to pass through device 22 and not reside within device 22 with the at least two angular electrical connectors 16*a*-16*d*. Additionally, any moisture or condensation that becomes positioned within device 22 can flow out of device 22 with at least two second channels 62*a*-62*d* having sloped bottoms (not shown) extending downwardly toward second perimeter wall structure 58 permitting condensation or moisture to flow out of device 22 thereby keeping at least two angular electrical connectors 16*a*-16*d* drier and avoiding corrosion.

With first and second components 24, 46 releasably secured together with at least two angular connectors 16*a*-16*d* positioned within first and second components 24, 46, each of at least two first portions 36*a*-36*d* align with one of at least two first openings 26*a*-26*d* and are each of the at least two first portions 36*a*-36*d* are connected to at least two antenna connectors 12*a*-12*d*. In addition, with each of at least two second portions 38*a*-38*d* positioned within one of at least two first channels 40*a*-40*d* and one of at least two second channels 62*a*-62*d*, a force applied to device 22 by way of a force applied to one or more cables 18 connected to at least two second portions 38*a*-38*b* and/or directly to one or more at least two second portions 38*a*-38*d*, the at least two first portions 36*a*-36*d* connected to the at least two antenna connectors 12*a*-12*d* resist rotation of device 22 about central axis 42 and thereby prevent torque being transmitted from at least two second portions 38*a*-38*d* to the at least two first portions 36*a*-36*d*.

Figure 8:
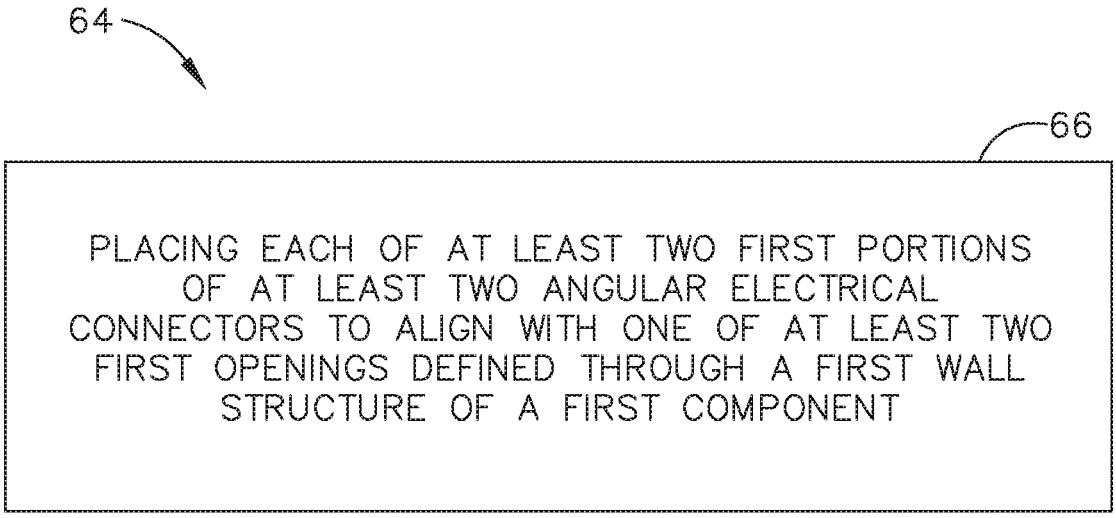
FIG. 8 is a flow chart for securing at least two angular connectors.

In referring to FIG. 8, method 64 for securing at least two angular connectors 16*a*-16*d* includes placing 66 each of at least two first portions 36*a*-36*d* of at least two angular connectors 16*a*-16*d* to align with one of at least two first openings 26*a*-26*d* defined through a first wall structure 28 of a first component 24. Method 64 further includes securing each of the at least two first portions 36*a*-36*d* of the at least two angular connectors 16*a*-16*d* so as to make in this example an electrical signal connection and in other applications, an electrical power connection, a gas connection or a fluid connection Method 64 further includes positioning each of at least two second portions 38*a*-38*d* of at least two angular connectors 16*a*-16*d* to align with one of at least two second openings 30*a*-30*d* defined through perimeter wall structure 32 of the first component 24, which extends about the first wall structure 28 and to be positioned within one of at least two first channels 40*a*-40*d* of first component 24. Method 64 further including releasably securing second component 46 to the first component 24, wherein the second component 46 includes at least two second channels 62*a*-62*d*, wherein each of the at the at least two second channels 62*a*-62*d* align with one of the at least two first channels 40*a*-40*d*, such that each of the at least two second portions 38*a*-38*d* of each of the at least two angular connectors 16*a*-16*d* is positioned between the first and second components 24, 46 are each positioned within one of the at least two first channels 40*a*-40*d* and within one of the at least two second channels 62*a*-62*d*.

While various embodiments have been described above, this disclosure is not intended to be limited thereto. Variations can be made to the disclosed embodiments that are still within the scope of the appended claims.

What is claimed is:

1. A device for securing at least two angular connectors, comprising:

a first component which includes:

at least two first openings defined through a first wall structure;

at least two second openings defined through a perimeter wall structure, which extends about the first wall structure; and at least two wall members, wherein each of the at least two wall members extend between one of the at least two second openings and one of the at least two first openings wherein each of the at least two wall members includes one of at least two first channels; and a second component positioned below the first component, which includes:

a second wall structure which defines at least two third openings, which extend through the second wall structure;

at least two second channels wherein each of the at least two second channels extend between at least one of the at least two third openings and one of at least two fourth openings of a second perimeter wall structure; and each of the at least second channels has a slope extending downwardly toward the second perimeter wall structure.

2. The device of claim 1, with at least two angular connectors positioned in the first component:

the at least two angular connectors comprise at least two first portions such that one of the at least two first portions is associated with one of the at least two angular connectors and each of the at least two first portions aligns with one of the at least two first openings; and the at least two angular connectors comprise at least two second portions such that one of the at least two second portions is associated with one of the at least two angular connectors and each of the at least two second portions aligns with one of the at least two second openings; and each of the at least two wall members, which includes one of the at the least two first channels, is positioned adjacent to and extends along one of the at least two second portions of each of the at least two angular connectors with the at least two angular connectors positioned in the first component.

3. The device of claim 2, wherein each of the at least two wall members extends between one of the at least two second openings and one of the at least two first openings.

4. The device of claim 2, wherein each of the at least two wall members comprises one of at least two first channels such that each one of at least two first channels associates with one of the at least two first openings and one of the at least two second openings.

5. The device of claim 4, wherein with at least two angular connectors positioned in first component, each of at least two first channels is in contact with one of the at least two second portions.

6. The device of claim 5, wherein with the at least two angled connectors positioned in the first component, each of the at least two first portions is aligned with one of the at least two first openings and each of the at least two second portions is positioned within one of the at least two first channels, such that one of the at least two second portions extends through one of the at least two second openings or a cable or conduit connected to one of the at least two second portions extends through the one of the at least two second openings.

7. The device of claim 1, wherein each of the at least two first openings is positioned spaced apart from a central axis of the first component.

8. The device of claim 1, wherein the second component is releasably secured to the first component.

9. The device of claim 8, wherein one of the first component or second component define a pair of securement openings which extend through the first component or the second component.

10. The device of claim 9, wherein other of the first component or second component include a pair of tab members.

11. The device of claim 10, wherein each of the pair of tab members have a head member such that with the head member of each of the pair of tab members positioned through the pair of securement openings, the first component is releasably secured to the second component.

12. The device of claim 8, wherein the second component has a second wall structure which defines at least two third openings extending through the second wall structure.

13. The device of claim 12, wherein the second perimeter wall structure extends about the second wall structure.

14. The device of claim 12, wherein with the first and second component releasably secured together:

each of the at least two second channels of the second component align with one of at least two first channels of the first component; and with the at least two angular connectors positioned between the first component and the second component:

each of at least two first portions of the at least two angular connectors is aligned with one of the at least two first openings; and each of at least two second portions of the at least two angular connectors is aligned and within one of at least two first channels and aligned and within one of at least two second channels.

15. The device of claim 12, wherein each of the at least two third openings of the second wall structure of the second component is aligned with one of the at least two first openings of the first component.

16. A method for securing at least two angular connectors, comprising:

placing each of at least two first portions of at least two angular connectors to align with one of at least two first openings defined through a first wall structure of a first component, which includes:

at least two first openings defined through a first wall structure;

at least two second openings defined through a perimeter wall structure, which extends about the first wall structure; and at least two wall members, wherein each of the at least two wall members extend between one of the at least two second openings and one of the at least two first openings wherein each of the at least two wall members includes one of at least two first channels; and placing a second component below the first component wherein the second component includes:

a second wall structure which defines at least two third openings, which extend through the second wall structure;

at least two second channels wherein each of the at least two second channels extend between at least one of the at least two third openings and one of at least two fourth openings of a second perimeter wall structure; and each of the at least two second channels has a slope extending downwardly toward the second perimeter wall structure.

17. The method of claim 16, further including securing each of the at least two first portions of the at least two angular connectors so as to make a connection.

18. The method of claim 17, further including positioning each of at least two second portions of at least two angular connectors to align with one of at least two second openings defined through a perimeter wall structure of the first component, which extends about the first wall structure and within one of at least two first channels of the first component.

19. The method of claim 18, further including releasably securing the second component to the first component, wherein each of the at the at least two second channels align with one of at least two first channels, such that one of at least two second portions of each of the at least two angular connectors is positioned between the first and second components and are each positioned within one of at least two first channels and within one of the at least two second channels.

20. The device of claim 2, wherein a collar, positioned about one of the at least two second portions, is in contact with one of the at least two first channels.

* * * * *